US011129482B2

(12) United States Patent
Borgman et al.

(10) Patent No.: US 11,129,482 B2
(45) Date of Patent: Sep. 28, 2021

(54) PERSON SUPPORT APPARATUS WITH INGRESS/EGRESS ASSIST

(71) Applicant: Hill-Rom Services, Inc., Batesville, IN (US)

(72) Inventors: Darrell Borgman, Batesville, IN (US); Frank E. Sauser, Cincinnati, OH (US); Joshua A. Williams, West Harrison, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 224 days.

(21) Appl. No.: 16/554,021

(22) Filed: Aug. 28, 2019

(65) Prior Publication Data

US 2019/0380505 A1 Dec. 19, 2019

Related U.S. Application Data

(62) Division of application No. 15/189,097, filed on Jun. 22, 2016, now Pat. No. 10,433,652.

(60) Provisional application No. 62/182,915, filed on Jun. 22, 2015.

(51) Int. Cl.

| | |
|---|---|
| ***A47C 27/08*** | (2006.01) |
| ***A47C 27/18*** | (2006.01) |
| ***A47C 27/10*** | (2006.01) |
| ***A61G 7/057*** | (2006.01) |
| ***A61G 7/012*** | (2006.01) |
| ***A61G 7/05*** | (2006.01) |
| ***A61G 7/053*** | (2006.01) |

(52) U.S. Cl.

CPC ..... *A47C 27/083* (2013.01); *A47C 27/10* (2013.01); *A47C 27/18* (2013.01); *A61G 7/012* (2013.01); *A61G 7/053* (2013.01); *A61G 7/0525* (2013.01); *A61G 7/05746* (2013.01)

(58) Field of Classification Search

CPC ... A47C 27/001; A47C 27/083; A47C 27/086; A47C 27/10; A47C 27/14; A47C 27/18; A61G 7/012; A61G 7/05; A61G 7/0525; A61G 7/053; A61G 7/057; A61G 7/05715; A61G 7/05723; A61G 7/0573; A61G 7/05738; A61G 7/05746; A61G 7/05769

See application file for complete search history.

(56) References Cited

U.S. PATENT DOCUMENTS

| | | | |
|---|---|---|---|
| 4,651,368 | A | 3/1987 | Santo |
| 4,942,635 | A | 7/1990 | Hargest et al. |
| 5,029,352 | A | 7/1991 | Hargest et al. |
| 5,036,559 | A | 8/1991 | Hargest |
| 5,394,576 | A | 3/1995 | Soltani et al. |

(Continued)

FOREIGN PATENT DOCUMENTS

| | | | |
|---|---|---|---|
| CA | 2316461 | A1 | 2/2001 |

*Primary Examiner* — Nicholas F Polito

(74) *Attorney, Agent, or Firm* — Dinsmore & Shohl

(57) ABSTRACT

Embodiments include a person support apparatus including a plurality of air fluidizable material, a tub, a foam bolster disposed along at least one wall of the tub and extending over the at least one wall, and an inflatable air bladder disposed above the foam bolster along the at least one wall of the tub. A method of assisting a person with ingress or egress of a person support apparatus by deflating the inflatable air bladder and adjusting a level of fluidization of the air fluidizable material such that the surface supporting the portion of the person is substantially level with a top of the foam bolster is also described.

6 Claims, 8 Drawing Sheets

(56) References Cited

U.S. PATENT DOCUMENTS

| | | | |
|---|---|---|---|
| 5,623,736 | A | 4/1997 | Soltani et al. |
| 6,574,813 | B2 | 6/2003 | Bolden et al. |
| 6,934,990 | B2 | 8/2005 | Rapisarda |
| 2010/0088825 | A1 | 4/2010 | Howell et al. |
| 2015/0289667 | A1 | 10/2015 | Oakhill et al. |

PERSON SUPPORT APPARATUS WITH INGRESS/EGRESS ASSIST

CROSS-REFERENCE TO RELATED APPLICATIONS

The present application is a divisional of U.S. patent application Ser. No. 15/189,097, entitled "Person Support Apparatus With Ingress/Egress Assist," filed Jun. 22, 2016, which claims priority to U.S. Provisional Patent Application Ser. No. 62/182,915, filed Jun. 22, 2015, and entitled "Person Support Apparatus With Ingress/Egress Assist," the entireties of which are incorporated by reference herein.

TECHNICAL FIELD

The present specification generally relates to person support apparatuses, and more specifically, to person support apparatuses having ingress/egress assist features.

BACKGROUND

Conventional air fluidized therapy (AFT) person support apparatuses include microspheres that are air fluidized to create a support surface. Many conventional AFT person support apparatuses include rigid walls or tanks that extend upward from the frame of the apparatus to contain the microspheres. However, the rigid walls make it difficult for a person to enter or exit the person support apparatus. Additionally, the rigid walls may be uncomfortable to a person on the person support apparatus.

Some AFT person support apparatuses include an air wall that provides cushioning over the rigid wall. However, the air wall is not supportive and may be unstable while a person attempts to enter or exit the person support apparatus.

Accordingly, a need exists for AFT person support apparatuses that provide stable support during ingress and egress.

SUMMARY

According to some embodiments of the present disclosure, a person support apparatus includes a plurality of air fluidizable microspheres and a tub containing the plurality of air fluidizable microspheres. The tub includes a plurality of walls, each of the plurality of walls having an internal surface. A foam bolster is disposed along the internal surface of at least one of the plurality of walls of the tub and extends over the wall. The person support apparatus also includes an inflatable air bladder disposed above the foam bolster along the at least one of the plurality of walls of the tub.

According to some embodiments of the present disclosure, a method of assisting a person with ingress or egress of a person support apparatus includes supporting a portion of a person on a surface formed by an air fludizable material contained within a tub. The tub includes a plurality walls extending upward from a bottom of the tub and a lip extending substantially perpendicular to each of the plurality of walls along a top of the tub. A foam bolster is disposed along an internal surface of each of the plurality of walls of the tub and extends over the lip of the tub. The method also includes deflating a first portion of an inflatable air bladder disposed above foam bolster and adjusting a level of fluidization of the air fluidizable material such that the surface supporting the portion of the person is substantially level with a top of the foam bolster.

According to some embodiments, a person support apparatus includes a first surface for supporting a first portion of a person and a second surface for supporting a second portion of the person. The first surface includes a plurality of air bladders. The second surface includes an air fluidizable material contained in a tub having a foam bolster disposed along an internal surface of each wall of the tub and an inflatable air bladder disposed above the foam bolster along each of the walls of the tub.

Additional features and advantages will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

Referring now to the illustrative examples in the drawings, wherein like numerals represent the same or similar elements throughout.

DETAILED DESCRIPTION

Figure 1A:
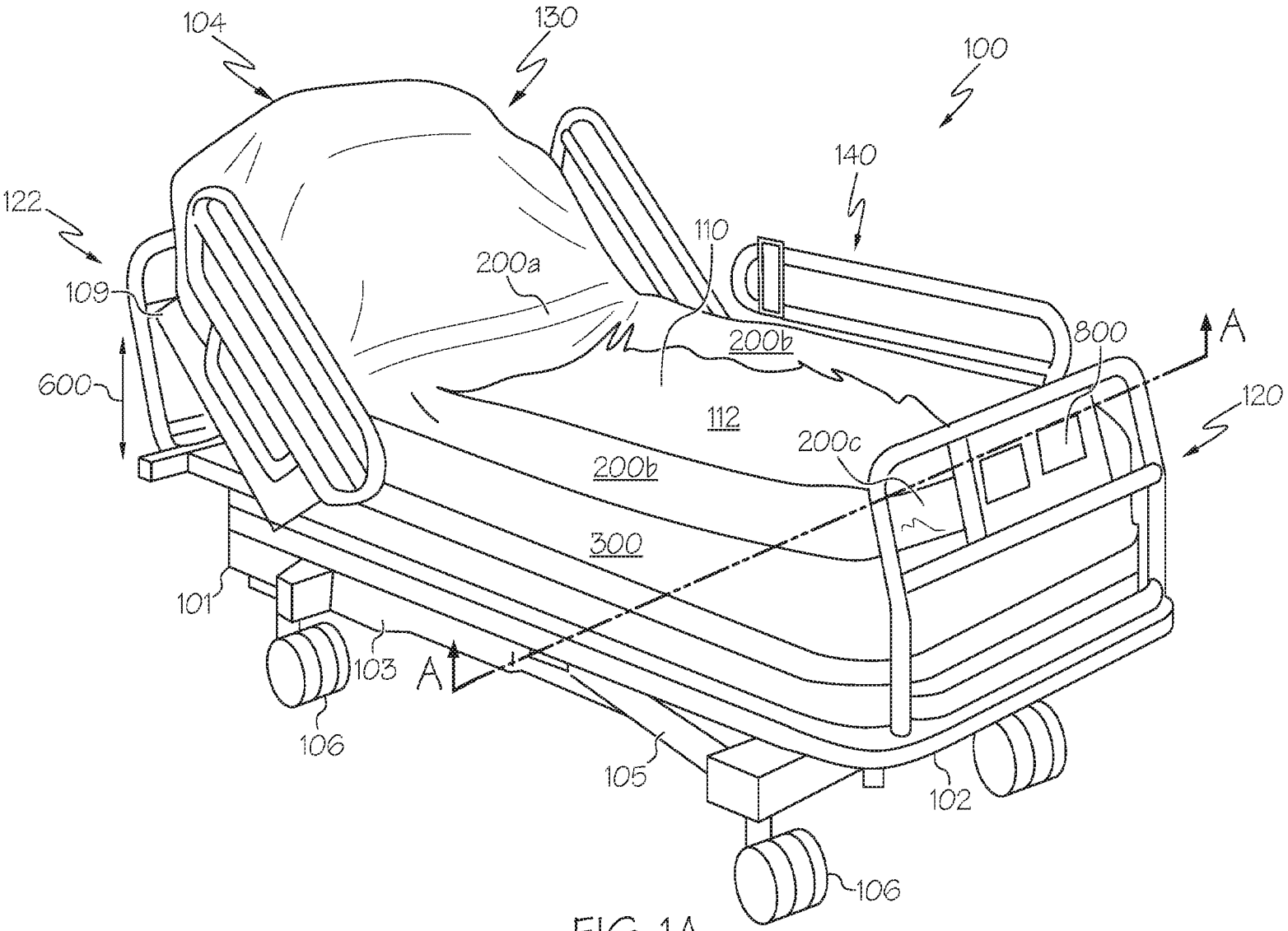
FIG. 1A schematically depicts a perspective view of a person support apparatus according to one or more embodiments shown and described herein.
Figure 1B:
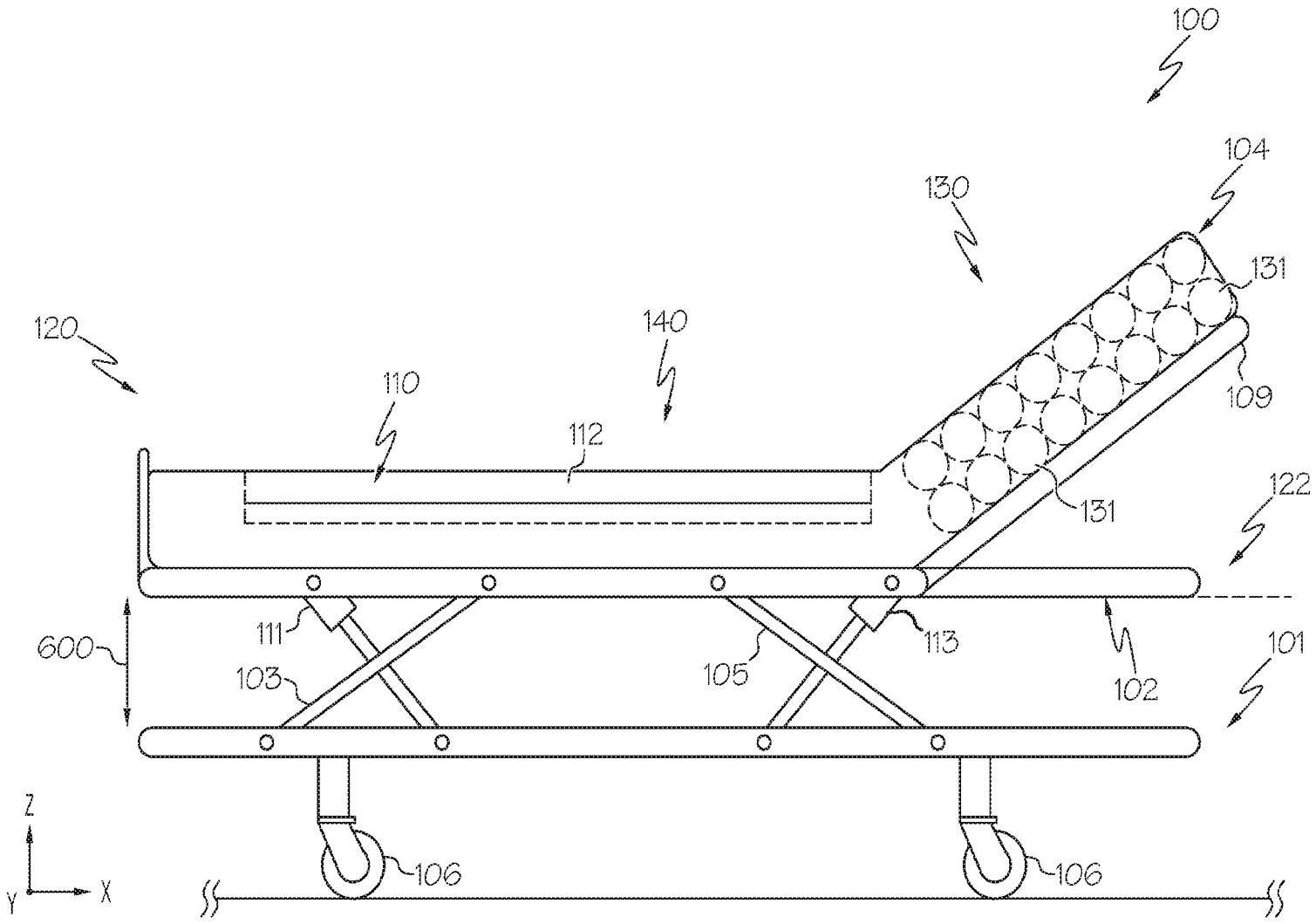
FIG. 1B schematically depicts a side view of a person support apparatus with ingress/egress assist features, according to one or more embodiments shown and described herein.

Referring now to FIGS. 1A and 1B, a person support apparatus 100 is depicted. The person support apparatus 100 may be, for example, a person support apparatus similar to the HILL-ROM® CLINITRON® RITE HITE® Air Fluidized Therapy bed or HILL-ROM® ENVELLA™ Air Fluidized Therapy bed, both commercially available from HILL-ROM® or Hill-Rom Services, Inc. of Batesville, Ind. However, it should be understood that other person support apparatuses compatible with the methods described herein are contemplated and possible.

The person support apparatus 100 generally includes a base frame 101 and an upper frame 102 on which a mattress system 104 is supported. The base frame 101 supports the person support apparatus 100 and may include wheels 106 to facilitate relocating and/or repositioning the person support apparatus 100. The upper frame 102 is coupled to the base frame 101 with pivoting linkages 103, 105 which facilitate raising and lowering the upper frame 102 with respect to the base frame 101, as indicated by arrow 600. More particularly, a first end of linkage 103 is pivotally coupled to the base frame 101 and a second end of linkage 103 is pivotally coupled to the upper frame 102. Similarly, a first end of linkage 105 is pivotally coupled to the base frame 101 and a second end of linkage 105 is pivotally coupled to the upper frame 102.

In addition, the person support apparatus 100 also includes actuators 111, 113 (shown in FIG. 1B) which, when actuated by an electronic control unit (not shown) communicatively coupled to the actuators 111, 113, raise and/or lower the upper frame 102 with respect to the base frame 101. Specifically, actuator 111 is pivotally coupled to the base frame 101 and the upper frame 102 proximate the foot end 120 of the person support apparatus 100 and actuator 113 is pivotally coupled to the base frame 101 and the upper frame 102 proximate the head end 122 of the person support apparatus. In the embodiments described herein, the actuators 111 are linear actuators. However, it should be understood that other actuators are contemplated including, without limitation, pneumatic actuators, hydraulic actuators, rotary actuators (e.g., motors), and the like.

Still referring to FIGS. 1A and 1B, in embodiments, the person support apparatus 100 may include a torso frame 109 which is pivotally coupled to the upper frame 102. The torso frame 109 may be pivoted with respect to the upper frame 102 thereby facilitating increasing an angle of inclination of the mattress system 104 proximate the head end 122 of the person support apparatus 100. In embodiments, an actuator (not shown) may be coupled to the upper frame 102 and the torso frame 109 to facilitate pivoting the torso frame 109 with respect to the upper frame 102 via an electronic control unit.

The mattress system 104 of the person support apparatus 100 includes an upper portion 130 and a lower portion 140. The upper portion 130 of the mattress system 104 is positioned on the torso frame 109 and provides a first surface for supporting at least a portion of a person. In some embodiments, the upper portion 130 of the mattress system 104 may generally include one or more fluid bladders 131 which may be inflated or deflated to adjust the position of a person on the mattress system 104 and/or increase or decrease the firmness of a portion of the mattress system 104 according to the person's preference.

The electronic control unit which controls pivoting of the torso frame 109 with respect to the upper frame 102, raising and lowering of the upper frame 102 with respect to the base frame, and inflation or deflation of the one or more fluid bladders 131 and the zones 200*a*, 200*b*, 200*c* of the inflatable air bladder 308 (as will be described in further detail below) may be coupled to one or more user input devices, such as one or more graphical user interfaces (GUIs) 800, as depicted in FIG. 1A. Although the GUI 800 depicted in FIG. 1A is coupled to a foot board at the foot end 120 of the person support apparatus 100, it is contemplated that the GUI 800 may be located elsewhere, such as within a siderail or a headboard of the person support apparatus 100 or as a hand-held device such as a pod or pendant that communicates via a wired or wireless connection with the electronic control unit.

Referring now to FIGS. 1A-4, the lower portion 140 of the mattress system 104 includes a bladder portion 110 enclosed by a tub 300. The bladder portion 110 provides a second surface for supporting at least a portion of a person. In various embodiments, the tub 300 may be made of fiberglass, metal, or a heat-resistant plastic. In some embodiments, the tub 300 is molded from fiberglass as a single piece. The tub 300 includes a bottom 302 and sidewalls 141*a*, 141*b*, 141*c*, 141*d*. The sidewalls 141*a*, 141*b*, 141*c*, 141*d* extend upward from the bottom 302 of the tub 300.

In various embodiments, a foam bolster 306 is positioned along an internal surface of each of the sidewalls 141*a*, 141*b*, 141*c*, 141*d* and extends over the sidewalls. For example, the foam bolster 306 may extend outward from the tub 300 and past the edge of the sidewalls 141*a*, 141*b*, 141*c*, 141*d*.

Figure 3:
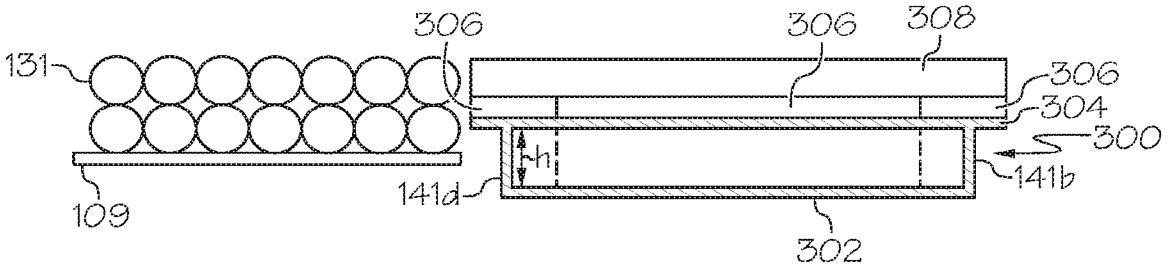
FIG. 3 schematically depicts an elevation view of the mattress system of the person support apparatus of FIG. 1B, according to one or more embodiments shown and described herein.
Figure 4:
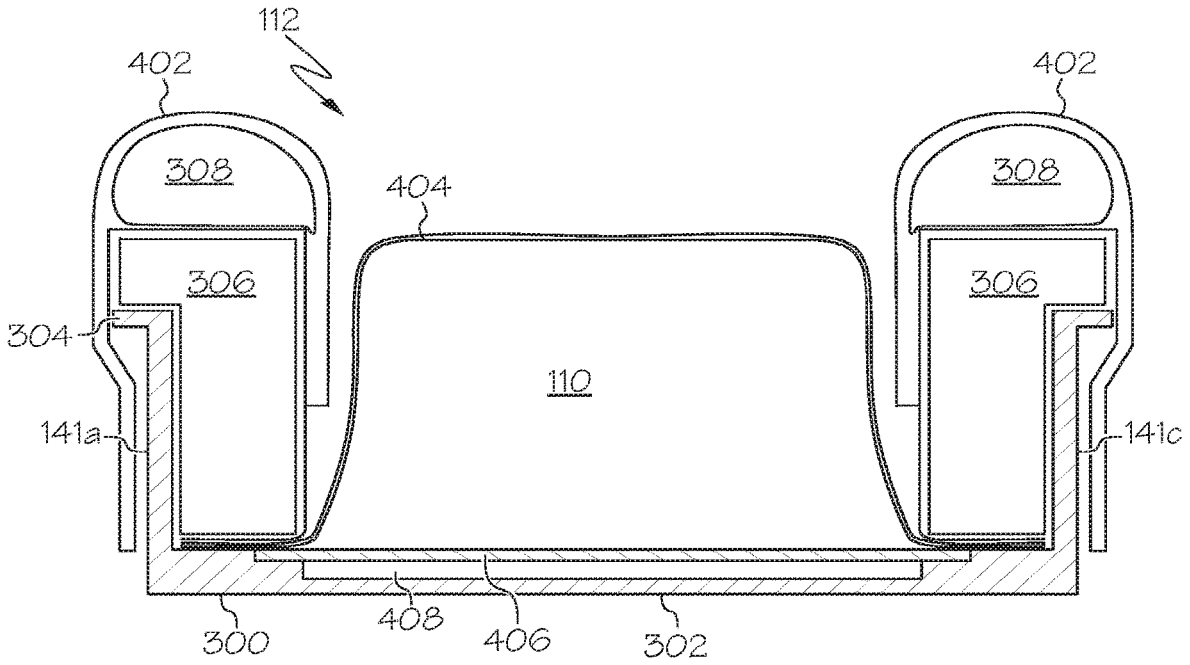
FIG. 4 schematically depicts a cross-section of the person support apparatus of FIG. 1A along line A-A, according to one or more embodiments shown and described herein.

In various embodiments, such as the embodiments shown in FIGS. 3 and 4, the tub 300 further includes a lip 304. As shown in FIGS. 3 and 4, the lip 304 extends substantially perpendicular to each of the four sidewalls along the top of the sidewalls of the tub 300. More particularly, in various embodiments, the lip 304 extends perpendicularly to a height h of each of the sidewalls 141*a*, 141*b*, 141*c*, and 141*d*. In various embodiments, the foam bolster 306 extends above the lip 304 of each of the sidewalls, as shown in FIGS. 3 and 4. In embodiments, the foam bolster 306 covers the lip 304 and provides cushioning support to a person moving over top of the lip 304 and the sidewalls 141*a*, 141*b*, 141*c*, 141*d*. In various embodiments, the foam bolster 306 is in direct contact with the internal surface of the sidewalls and the lip 304.

The foam bolster may be, for example, open and/or closed cell polyurethane foam or a polymeric deformable material, and may have a thickness of at least about 2 inches. Accordingly, in embodiments in which the tub 300 includes a lip 304, the foam bolster 306 may extend at least about 2 inches above the lip 304. The thickness of the foam bolster 306 may vary depending on the particular embodiment, and may depend, at least in part, on the particular material employed.

Various embodiments further include an inflatable air bladder 308 disposed above the foam bolster 306 along each of the sidewalls 141*a*, 141*b*, 141*c*, 141*d* of the tub 300. By supplying air to the inflatable air bladder 308, the air bladder 308 can facilitate enhancing the comfort of the person coming into contact with the sidewalls of the tub 300. The inflatable air bladder 308 also provides a means for retaining the fluidizable material and boundaries for the bladder portion 110.

Figure 2:
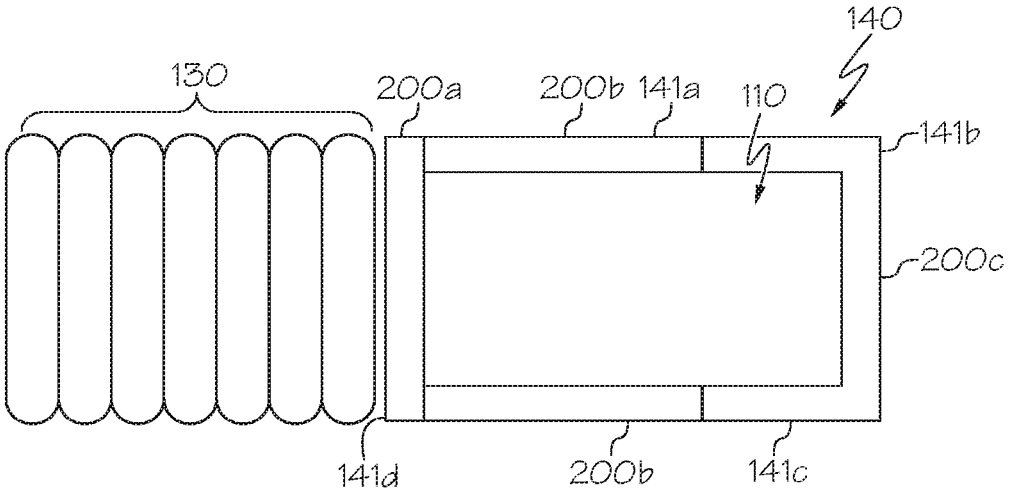
FIG. 2 schematically depicts a top view of the mattress system of the person support apparatus of FIG. 1B, according to one or more embodiments shown and described herein.

In various embodiments, the inflatable air bladder 308 is separated into a plurality of zones. For example, in the embodiment depicted in FIG. 2, the inflatable air bladder 308 is separated into three zones 200*a*, 200*b*, 200*c*. In FIG. 2, zone 200*a* is a lumbar zone which is positioned adjacent to the upper portion 130 of the mattress system 104. Zone 200*b*, which includes a zone on each side of the person support apparatus 100, forms an ingress/egress zone. Zone 200*c* forms a foot zone that is positioned along the foot end 120 of the person support apparatus 100. In various embodiments, the zone 200*c* extends partially along the sides of the person support apparatus, as shown in FIG. 2.

In various embodiments, each of the zones 200*a*, 200*b*, 200*c*, is separately and individually inflatable and deflatable, as will be described in greater detail hereinbelow. Accordingly, when a person is entering or exiting the person support apparatus 100, the ingress/egress zone 200*b* may be deflated such that the person is supported by the stable foam bolster 306 as he or she moves over the edge of the person support apparatus 100 while the remaining zones 200*a* and 200*c* are kept in an inflated form. In various embodiments, when one or more zones 200*a*, 200*b*, 200*c* are deflated, the top surface of the bladder portion 110 is substantially level with the top of the foam bolster 306.

According to various embodiments, the bladder portion 110 contains particulate material, such as glass and/or ceramic microspheres (i.e., beads). A fluidization system (not shown), such as a pump, may be used to pump a fluid, such as a gas or air, into the interior volume of the bladder portion 110, thereby fluidizing the particulate material and creating a central, fluidized bed 112 in the lower portion 140 of the mattress system 104. This fluidized bed 112 assists in distributing and redistributing pressure against the skin of a person positioned on the mattress system 104. Additionally, in various embodiments, the fluidization system may be used to increase or decrease the volume of the bladder portion 110, such as to position the top surface of the bladder portion 110 substantially level with the top of the foam bolster 306 for ingress/egress of a person, as shown in FIG. 4.

Referring now to FIGS. 2 and 3, the fluidization of the particulate matter to create the fluidized bed 112 causes the particulate matter within the bladder portion 110 to be fairly mobile and readily distributed (or redistributed) throughout the bladder portion 110. That is, when the upper frame 102 is level with respect to horizontal (i.e., gravity), the particulate material will have a uniform depth within the bladder portion 110. However, when the upper frame 102 is at an angle with respect to horizontal, the particulate matter will migrate to one end of the bladder portion 110 due to gravity.

FIG. 4 depicts a cross section of the person support system shown in FIG. 1A along the line A-A. As described above, FIG. 4 illustrates a bladder portion 110 positioned within a tub 300. A foam bolster 306 is disposed along the internal surface of the walls 141*a* and 141*c*, and extends over a lip 304 of each of the walls 141*a* and 141*c*. Additionally, the inflatable air bladder 308 is disposed above the foam bolster 306.

FIG. 4 also depicts a bladder cover 402 that extends along an exterior surface of each wall 141*a*, 141*c*, over the inflatable air bladder 308, and along an interior of the fluidized bed 112. The bladder cover 402 may serve to retain the inflatable air bladder 308, preventing lateral spreading of the inflatable air bladder 308. In some embodiments, the bladder cover 308 further prevents contamination of the inflatable air bladder 308 and the foam bolster 306, such as from bodily fluids or other contaminants. The bladder cover 402 may be made of an elastomeric material or other material that is generally fluid impermeable and durable. By way of example and not limitation, the bladder cover 402 may be made of a vinyl, polyurethane, or fabric coated with vinyl or polyurethane. The bladder cover 402 may be secured to the interior and/or exterior of the tub 300 using snaps or other attachment mechanisms.

Also shown in FIG. 4 is a cover sheet 404 to assist in containing the fluidizable material within the bladder portion 110. The cover sheet 404 encloses the fluidizable material by being connected to the tub 300 in a fashion that is impermeable to the passage of the fluidizable material. In various embodiments, the cover sheet 404 is air permeable, and may be formed of a fabric mesh, for example. The cover sheet 404 is connected to the tub 300 and a diffuser board 406 to contain the fluidizable material and permit fluidization thereof.

The diffuser board 406 supports the fluidizable material of the bladder portion 110. The diffuser board 406 is impermeable to the fluidizable material while being permeable to air to permit the introduction of air to fluidize the fluidizable material. For example, the diffuser board 406 may be formed of particle board or another air-permeable material that is impermeable to the passage of the particles of the fluidizable material. In some embodiments, the diffuser board 406 may be supported by a perforate metal plate or other support material to support and reinforce the diffuser board 406.

The diffuser board 406, along with the bottom 302 of the tub 300, defines a plenum 408. In some embodiments, the plenum 408 may be divided into two or more separate plenum chambers to enable air to be supplied to one chamber at a different pressure than the second chamber. However, in other embodiments, the plenum 408 is a single chamber. Air is supplied to the plenum 408 by an air supply system, such as the air supply systems described in accordance with FIGS. 5A and 5B below, and passes through the diffuser board 406 to fluidize the fluidizable material in the bladder portion 110 of the fluidized bed 112.

Figure 5A:
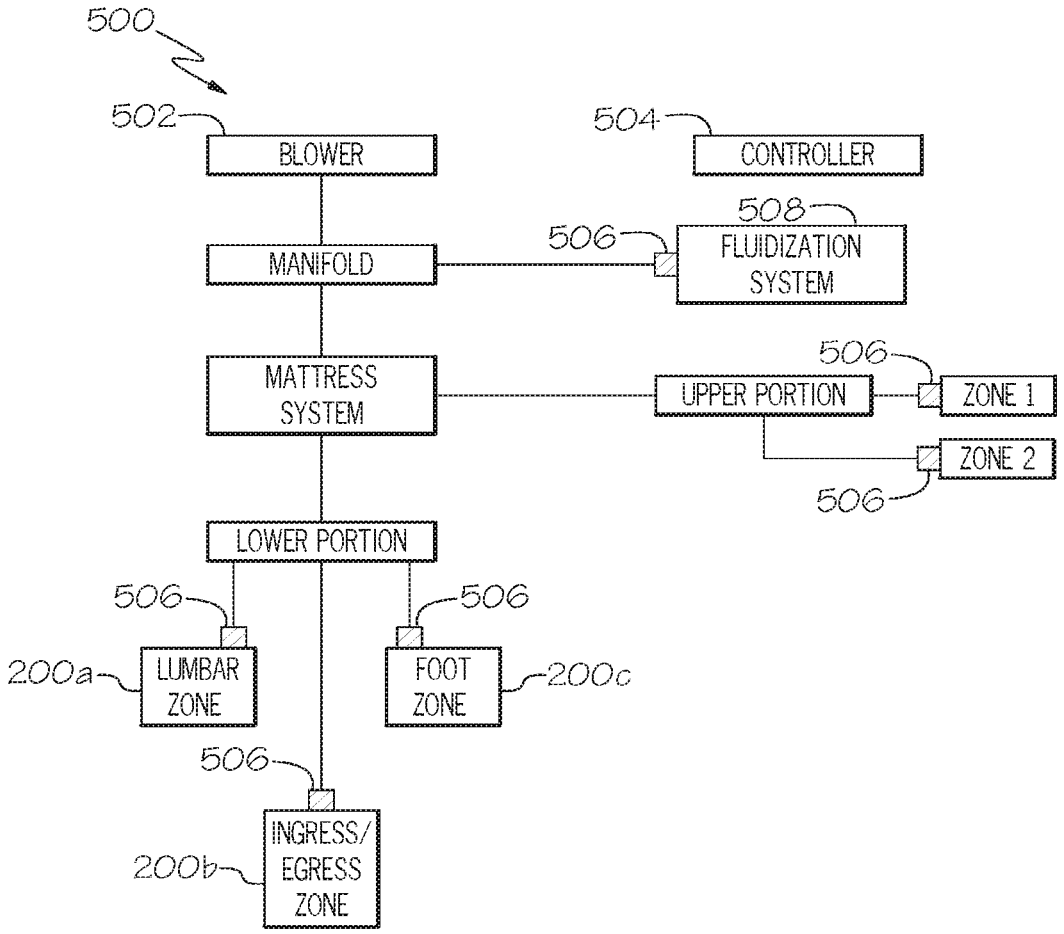
FIG. 5A is a block diagram of an air supply system according to one or more embodiments shown and described herein.

Turning now to FIG. 5A, an air supply system 500 is shown. Various embodiments include an air supply, such as a blower 502, and a controller 504 for supplying air to each of the zones 200*a*, 200*b*, 200*c* of the inflatable air bladder 308 as well as the upper portion 130 of the mattress system 104. The controller 504 may be a microprocessor that is operable to control various valves, select a pressure or flow for each valve, and regulate pressure or flow through each valve in accordance with the selected pressure or flow.

As discussed above, in various embodiments, the zones 200*a*, 200*b*, 200*c* of the inflatable air bladder, the upper portion 130 of the mattress system 104, and the fluidization system are each separately and individually controllable. Accordingly, each of the zones of the inflatable air bladder, the upper portion 130 of the mattress system 104, and the fluidization system includes a valve 506, such as a pressure control valve or a flow control valve, that is controlled by the controller 504. As shown in FIG. 5A, the controller 504 controls six zones: two zones that make up the upper portion 130 of the mattress system 104, three zones 200*a*, 200*b*, 200*c* of the inflatable air bladder, and the fluidization system 508.

As shown in FIG. 5A, each of the six zones may be individually and separately maintained at different pressures and/or flow rates of air by blower 502. The blower 502 provides sufficient air to each valve 506 to maintain the pressure selected by the controller 504. The blower 502 provides air to the fluidization system 508 which in turn provides air flow through one or more plenum chambers which fluidize the fluidizable material. The air flow that is permitted to pass through each valve 506 is controlled by the controller 504. In various embodiments, the blower 502 blows air through one or more air supply tubes that are connected to each valve 506.

Figure 5B:
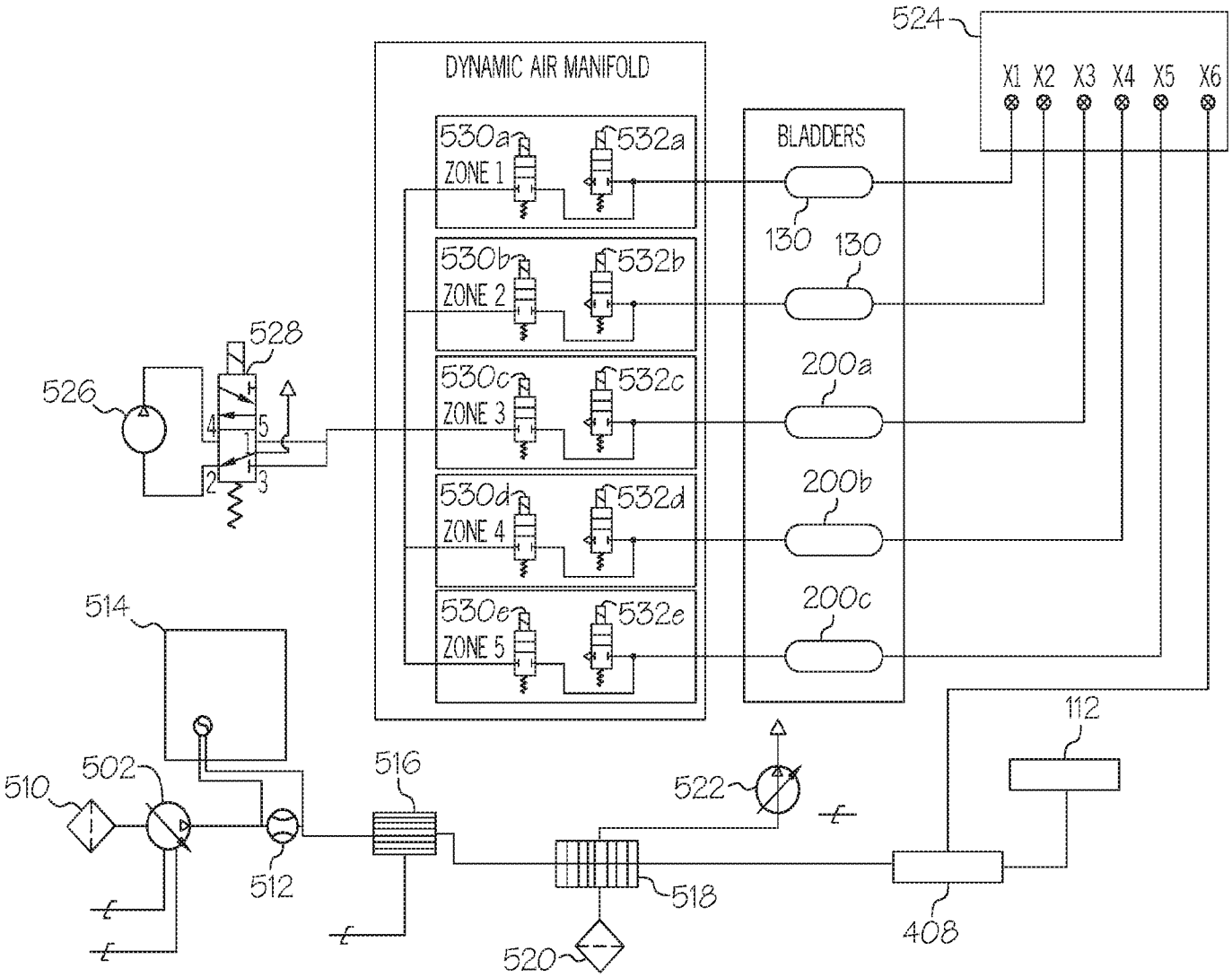
FIG. 5B is a schematic diagram of another air supply system according to one or more embodiments shown and described herein.

FIG. 5B depicts another embodiment of an air supply system according to various embodiments. In particular, FIG. 5B depicts the fluidization system and the mattress system in greater detail. Referring first to the fluidization system, the blower 502 brings air into the system through an air filter 510 and blows it through a flow meter 512. A monitoring board 514 monitors the flow of air across the flow meter 512 and adjusts the blower 502 accordingly. For example, if there is too much air passing through the flow meter 512, the monitoring board 514 may reduce the power to the blower 502 thereby reducing a speed of the blower.

After passing through the flow meter 512, the air is directed through a heater 516 which heats the air. In various embodiments, the heater 516 includes a temperature sensor, although in alternative embodiments, the temperature sensor may be a standalone sensor. The heated air is then passed to a heat exchanger 518, which further adjusts the temperature of the air. For example, the heat exchanger may draw additional air into the system through the filter 520 to cool the air provided to the plenum 408 and the fluidized bed 112. The heat exchanger 518 is further connected to a heat exchanger fan 522, which draws heat away from the heat exchanger 518. As shown in FIG. 5B, the plenum 408 is additionally connected to a monitor board 524, which monitors the pressure in the plenum 408. The monitor board 524 is configured to trigger an alarm responsive to determining that the pressure in the plenum 408 is outside of a desired pressure range. In various embodiments, the monitor board 524 is further connected to a controller, such as controller 504, to provide feedback to the fluidization system and enable adjustment of the fluidization system through the controller 504.

In FIG. 5B, the monitor board 524 is further connected to each of the air bladders that make up the two zones of the upper portion 130 of the mattress system 104, and the three zones 200*a*, 200*b*, 200*c* of the inflatable air bladder. The monitor board 524 is configured to monitor the pressure in each of the air bladders and trigger an alarm responsive to determining that the pressure is outside of a desired pressure range.

The air supply system depicted in FIG. 5B further supplies air to the various air bladders for the mattress system. As depicted in FIG. 5B, the compressor 526 provides air through a switching valve 528. The switching valve 528 may provide air to one or more of the zones in the manifold. In particular, the switching valve 528 may provide air from the compressor to one of the fill valves 530*a*, 530*b*, 530*c*, 530*d*, or 530*e*. When the corresponding fill valve is open, the air passes through the fill valve into the bladders making up the two zones of the upper portion 130 of the mattress system 104 and/or the three zones 200*a*, 200*b*, 200*c* of the inflatable air bladder to fill or increase the pressure in the air bladder. When the air bladder is to be emptied, the vent valve 532*a*, 532*b*, 532*c*, 532*d*, or 532*e* corresponding to the air bladder to be emptied is opened and air may be permitted to escape into the environment.

In various embodiments, the compressor 526 may function as a vacuum to evacuate air from one or more of the air bladders. For example, when the person is prepared to exit the person support apparatus, the switching valve 528 may be switched to cause the compressor 526 to pull a vacuum. Then, the fill valve 530*d* may be opened while the fill valves 530*a*, 530*b*, 530*c*, and 530*e* remain closed, to evacuate air from the ingress/egress zone 200*b*, thereby deflating and decreasing a height of the corresponding air bladder.

Figure 6:
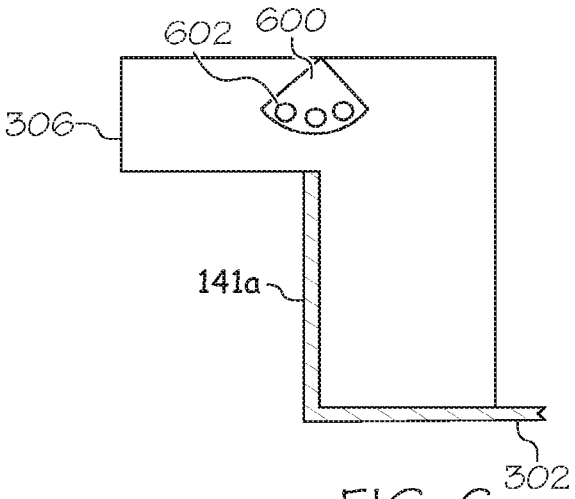
FIG. 6 schematically depicts a cross-section of a foam bolster according to one or more embodiments shown and described herein.

Turning now to FIG. 6, a cross-section of the foam bolster 306 is illustrated. As shown in FIG. 6, in some embodiments, the foam bolster 306 includes a channel 600 along the top of the foam bolster 306 for receiving one or more tubes 602. The tubes 602 may be, for example, air supply tubes from the blower 502 for inflating the inflatable air bladder, cables connecting the valve 506 of one of the zones 200*a*, 200*b*, 200*c* to the controller 504, or the like. In various embodiments, the tubes 602 are received by the channel 600 of the foam bolster 306 to protect the tubes 602 as well as to provide a barrier between the tubes 602 and a person on the person support apparatus. For example, when the tubes 602 are hidden within the foam bolster 306, the person may not feel the tubes which may be uncomfortable to the person.

Figure 7:
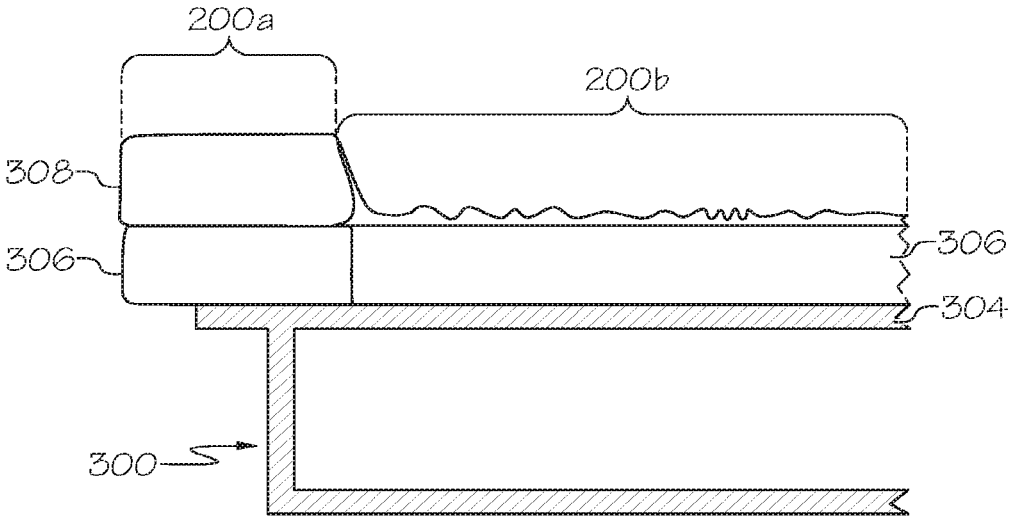
FIG. 7 schematically depicts a person support apparatus having a portion of an inflatable air bladder deflated for ingress/egress according to one or more embodiments shown and described herein.

In various embodiments, a method of assisting a person with ingress or egress of a person support apparatus is provided. In such embodiments, a portion of the inflatable air bladder is deflated and at least partially collapsed, as shown in FIG. 7. For example, the zone 200*b* of the inflatable air bladder is deflated and at least partially collapsed such that the zone 200*b* adds substantially no height to the side of the person support apparatus. In various embodiments, the method also includes adjusting the level of fluidization of the air fluidizable material such that the surface supporting the person is substantially level with the top of the foam bolster 306, as shown in FIG. 4. The reduced height of the side of the person support apparatus resulting from the deflation and collapse of the zone 200*b* along with the adjusted level of the air fluidizable material renders the lower portion 140 of the person support apparatus low enough to permit the person to traverse the sidewalls relatively easily during ingress or egress. Additionally, the foam bolster 306 provides a supportive surface to assist the person with ingress or egress. That is, the foam bolster 306 prevents the person from coming in contact with the relatively hard surfaces of the tub 304.

Figure 8:
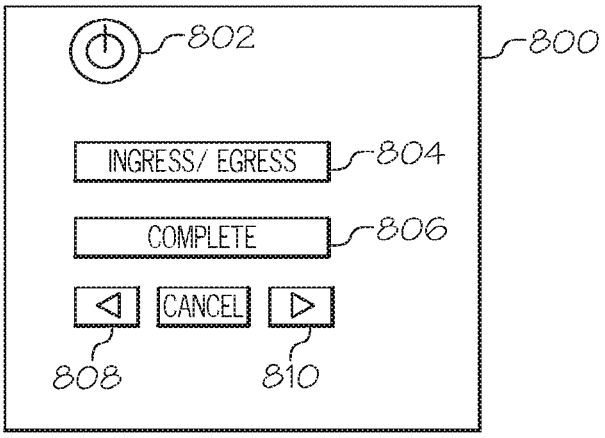
FIG. 8 schematically depicts a graphical user interface for use with a person support apparatus according to one or more embodiments shown and described herein.

FIG. 8 depicts an example GUI 800 for use with various embodiments. In various embodiments, the GUI is operable to control one or more features or functions of the person support apparatus 100. In particular, the GUI 800 may receive user inputs, such as requests to prepare the person support apparatus 100 for ingress or egress. As shown in FIG. 8, the GUI 800 includes a power button 802, an ingress/egress button 804, a "complete" button 806, a left button 808, and a right button 810. Although the GUI 800 is depicted as including various buttons, it is contemplated that GUIs may have more or fewer buttons. The buttons 802, 804, 806, 808, 810 may be icons that are graphically displayed on a display with touch screen capabilities. In various embodiments, the buttons are selectable by the user to control features or functions of the person support apparatus 100. For example, in some embodiments, selection of the power button 802 may result in the GUI being turned on or off. As another example, selection of the ingress/egress button 804 may result in a screen that prompts the user to select one of the left button 808 or the right button 810. Selection of the left button 808 or the right button 810 results in the corresponding zone 200*b* being deflated to enable the person to ingress or egress from the person support apparatus 100. Selection of the "complete" button 806 may result in the deflated zone 200*b* being re-inflated.

In embodiments, when a person is ready to egress from the person support apparatus 100, a user may select the power button 802 on the GUI 800 to turn on the display and access other buttons, such as the ingress/egress button 804. Selection of the ingress/egress button 804 causes the electronic control unit to increase the fluidization of the fluidized bed 112 such that the top surface of the bladder portion 110 substantially level with the top of the foam bolster 306 for ingress/egress of a person, as shown in FIG. 4. In particular, the electronic control unit turns on the blower 502, which pulls air in through the air filter 510, passes the air through the flow meter 512 and heat exchanger 518, and into the plenum 408 and the fluidized bed 112. Next, responsive to user selection of the left button 808, the electronic control unit starts the compressor 526 and switches the switching valve 528 so as to create a vacuum. The electronic control unit then opens valve 530*d*, evacuating air from the zone 200*b* on the left side of the person support apparatus 100 while maintaining pressure in the remaining zones 200*a*, 200*b* (on the right side of the person support apparatus), and 200*c*, as shown in FIG. 7. The person then slides over the foam bolster 306 of the left side of the person support apparatus 100. In order to return the zone 200*b* to its inflated position, the user may select the "complete" button 806 on the GUI 800.

In various embodiments, when the portion of the inflatable air bladder is deflated to assist the person with ingress or egress, inflation of one or more additional portions of the inflatable air bladder is maintained. For example, the zone 200*b* may be deflated and at least partially collapsed such that the zone 200*b* adds substantially no height to the side of the person support apparatus while inflation of the zones 200*a*, 200*c*, and 200*d* are maintained.

Various embodiments described herein include person support apparatus having a foam bolster provided over a tub containing fluidizable material and an inflatable air bladder positioned above the foam bolster. In various embodiments, a portion of the inflatable air bladder may be deflated to reduce a height of a side of the person support apparatus while the foam bolster provides support to a person for ingress or egress of the person support apparatus. Various embodiments provide that the foam bolster extends over the side of the tub so as to provide a cushioning and supportive surface.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A method of assisting a person with ingress or egress of a person support apparatus, the method comprising:

supporting a first portion of a person on a first surface formed by a plurality of fluid bladders;

supporting a second portion of a person on a second surface formed by an air fluidizable material contained within a tub, the tub having a foam bolster disposed along an internal surface of at least one wall of the tub and an inflatable air bladder disposed above the foam bolster along the at least one wall of the tub, wherein the foam bolster is in direct contact with the tub, and a lip extending perpendicularly from a top of the at least one wall of the tub, wherein the foam bolster extends above the lip of the tub, and a bladder cover extending along an exterior surface of the at least one wall of the tub, over the inflatable air bladder, and between the second surface and the foam bolster and the inflatable air bladder;

deflating a first portion of the inflatable air bladder disposed above the foam bolster; and adjusting a level of fluidization of the air fluidizable material such that the second surface supporting the second portion of the person is substantially level with a top of the foam bolster.

2. The method of assisting a person with ingress or egress of a person support apparatus according to claim 1, wherein the method further comprises maintaining inflation of one or more additional portions of the inflatable air bladder during deflation of the first portion.

3. The method of assisting a person with ingress or egress of a person support apparatus according to claim 2, wherein the one or more additional portions of the inflatable air bladder extend along a foot end and partially along the sides of the person support apparatus.

4. The method of assisting a person with ingress or egress of a person support apparatus according to claim 3, wherein the one or more additional portions of the inflatable air bladder comprise a lumbar zone positioned adjacent to the first surface, an ingress/egress zone positioned along a left side and a right side of the person support apparatus, and a foot zone positioned along a foot end of the person support apparatus.

5. The method of assisting a person with ingress or egress of a person support apparatus according to claim 3, further comprising separately and individually controlling the inflation of the one or more additional portions of the inflatable air bladder.

6. The method of assisting a person with ingress or egress of a person support apparatus according to claim 1, wherein the foam bolster comprises a channel along a top portion of the foam bolster for receiving one or more tubes for inflating the one or more additional portions of the inflatable air bladder.

* * * * *